US005185053A

United States Patent [19]

Tomashauser et al.

[11] Patent Number: 5,185,053

[45] Date of Patent: Feb. 9, 1993

[54] BRUSHING STATION FOR A LABELLING MACHINE FOR LABELLING BOTTLES AND THE LIKE

[75] Inventors: Josef Tomashauser, Willich; Rudolf Zodrow, Düsseldorf, both of Fed. Rep. of Germany

[73] Assignee: ETI-TEC Maschinenbau GmbH, Erkrath, Fed. Rep. of Germany

[21] Appl. No.: 595,453

[22] Filed: Oct. 10, 1990

Related U.S. Application Data

[63] Continuation-in-part of Ser. No. 311,609, Feb. 15, 1989, Pat. No. 4,976,803.

[30] Foreign Application Priority Data

Oct. 10, 1989 [DE] Fed. Rep. of Germany ..... 3933804

[51] Int. Cl.[5] ..... B65C 9/00

[52] U.S. Cl. ..... 156/487; 156/568; 156/571

[58] Field of Search ..... 156/567, 571, 568, 487; 118/230

[56] References Cited

U.S. PATENT DOCUMENTS

| | | | |
|---|---|---|---|
| 2,708,502 | 5/1955 | Carter | 198/33 |
| 3,200,027 | 8/1965 | Fairest | 156/571 X |
| 4,414,056 | 11/1983 | Buchholz et al. | 156/567 X |
| 4,594,123 | 6/1986 | Eder | 156/571 X |

FOREIGN PATENT DOCUMENTS

| | | |
|---|---|---|
| 391729 | 8/1921 | Fed. Rep. of Germany . |
| 1170815 | 3/1962 | Fed. Rep. of Germany . |
| 2027416 | 12/1971 | Fed. Rep. of Germany . |
| 3104807 | 7/1982 | Fed. Rep. of Germany . |
| 8512906 | 5/1989 | Fed. Rep. of Germany . |
| 1294574 | 4/1962 | France . |

*Primary Examiner*—David A. Simmons
*Assistant Examiner*—James J. Engel, Jr.
*Attorney, Agent, or Firm*—Nils H. Ljungman and Associates

[57] ABSTRACT

A brushing station for bottles with a turntable that has an unhooded bottle support mounted so that it can rotate on a substructure. On the outside circumference of the bottle support are receptacles formed by rotary plates and centering heads for the bottles to which foil sheets are to be applied. The drive mechanisms for the rotary plates and the drive mechanisms for the centering heads are cam transmissions which are installed in an enclosed space that is formed by the substructure and the bottle support that are in the form of a shell. The centering heads are supported by cantilever arms on columns, that are axially guided in a central guide body located between the receptacles. The guide body, on its outside circumference, has a pivot or rotational bearing for a support ring, that supports brush elements that are located on the inside of the path of the bottles. The support ring is held and prevented from rotating by a holder that is positioned in the area of the guide between the feeder star wheel and the discharge star wheel.

20 Claims, 9 Drawing Sheets

FIG. 10
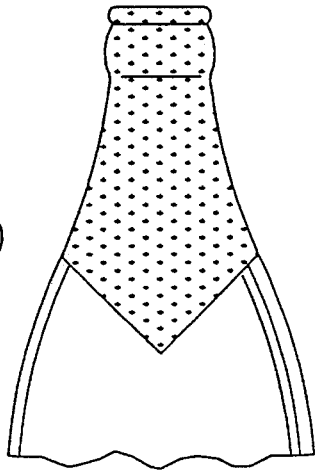
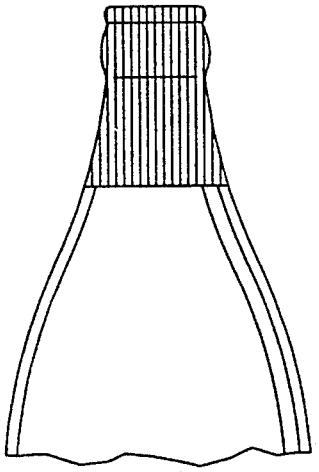
FIG. 11
FIG. 12
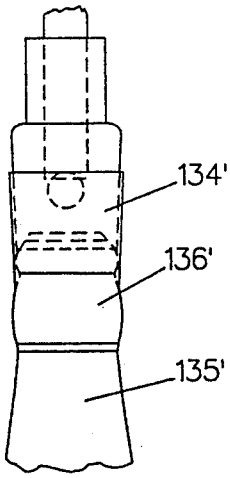

BRUSHING STATION FOR A LABELLING MACHINE FOR LABELLING BOTTLES AND THE LIKE

CONTINUING APPLICATION DATA

This application is a continuation-in-part application of U.S. Ser. No. 07/311,609, filed on Feb. 15, 1989, now U.S. Pat. No. 4,976,803.

BACKGROUND OF THE INVENTION

1. Field of the Invention

This invention relates to a brushing station for a labelling machine for labelling bottles and the like. The labelling machine has a turntable located between a feeder star wheel and a discharge star wheel. The turntable has a rotating, un-hooded or non-hooded bottle support positioned on a substructure, and receptacles for receiving the bottles along its circumference. At least one brush element is located along the circumference of the turntable. Each bottle receptacle has a motorized rotary plate and a bottle centering head that is supported by a radial cantilever arm. The cantilever arm, in turn, is supported on a column that is mounted on the bottle support and is axially moved or adjusted by an actuator. Both the rotation drive mechanism that rotates the rotary plate and the actuator that moves the columns are cam driven devices. Each cam driven device has a common, stationary cam positioned in the substructure for operating the cam drives of the rotation drive mechanism and the cam drives of the actuator.

The labelling machine includes a pressing station for metal foil sheets placed around the top and the neck of the bottles. A transfer station is located on the turntable that transfers the metal foil sheets to the bottles. Also provided is a delivery star wheel having bell-shaped pressing elements that can be moved axially by a cam controlled drive mechanism toward the bottle top. The pressing elements are held by a support located above the delivery star wheel and rotates with the delivery star wheel.

2. Background Information

Labelling machines having unhooded, or non-hooded, bottle supports are known. See, for example, German Patent No. 391 729 and French Patent No. 1,294,574. In comparison with other labelling machines having a hood located over the bottle supports to support the centering heads and their drive mechanisms, the non-hooded labelling machines have the advantage of easier access for servicing and maintenance. Nevertheless, the majority of the labelling machines in current use have a hood over the bottle support, primarily because when there are a great many receptacles, it is easier to adjust the height of all of the centering heads at once when changing from one format to another.

One labelling machine of the prior art, as disclosed in French Patent No. 1,294,574, has each column mounted in a guide sleeve located on the bottle support. The brush elements are located both on the inside and on the outside of the circulation path of the bottles. While it is possible to easily achieve a stationary fastening of the outside brush elements, the stationary fastening of the inside brush elements is difficult because of the rotating parts in the inner region of the support. The prior art does not propose any possible solutions to this problem.

An additional feature of prior art labelling machines is that restoring springs are employed to operate the cam-controlled movement of the centering elements. These restoring springs are provided to hold the engagement elements of the cam-controlled transmissions against the cam. That is possible, however, only if the amount of spring force is provided as a function of the mass acceleration forces which are present. Since the restoring springs must move the engagement elements, the columns, the cantilever arms and the centering heads, correspondingly large springs are required to produce even small forces.

On such pressing stations, the rotating paths of the delivery positions of the turntable and of the delivery star wheel overlap so that the bottles can be transferred in synchronization from the turntable to the delivery star wheel. Since, during transport of the bottles both in the turntable and in the delivery star wheel, elements such as centering heads grip the tops of the bottles when the bottles are on the turntable and pressing elements grip the tops of the bottles when the bottles are on the delivery star wheel, it is difficult to achieve a collision-free fit of the elements of the turntable and of the delivery star wheel in the overlapping region. Also, for purposes of transferring the bottles from the turntable to the delivery star wheel at the proper angle of rotation, the bottles in the turntable must be held as long as possible in a rotation-free manner by axial bracing between the turntable which supports the bottom of the bottle, and the centering element which grips the top of the bottle. For a collision-free passage of the pressing elements of the delivery star wheel, it is necessary to move the pressing elements out of the overlapping area during the passage.

In German Laid Open Patent Appln. No. 31 04 807 C2, which corresponds to U.S. Pat. No. 4,414,056, this problem is approached by equipping each pressing element so that it can pivot to one side from its position above the receiving position, into a position which lies outside the portion of the turntable traversed by the centering head of the turntable. Only when the pressing element has passed the overlapping area can it be pivoted over the bottle top of the corresponding receiving position, and then lowered to press the foil sheet. One disadvantage of such pressing stations is that a great deal of space is required for the pivoting movement, and the drive and transmission mechanisms required for the pivoting motion and the subsequent axial movement are quite complex and expensive.

These disadvantages related to the pivoting movement do not occur on another pressing station disclosed in German Laid Open Patent No. 35 15 730 A1. In that patent, the pressing elements are located so that they pivot on the circumference of a support that has a smaller diameter than that of the delivery star wheel, and is mismatched in relation to the delivery star wheel. With that configuration, the path of the pressing elements lies outside the path of the receiving positions of the turntable and only above a short segment of the path of the receiving positions of the delivery star wheel. A disadvantage, however, is that synchronization between the receiving positions of the delivery star wheel and the pressing elements can only be achieved over the above-mentioned short segment, and then only approximately, which has a negative effect on the quality of the pressing of the foil sheet.

On the pressing stations described above however, a collision-free passage of the pressing elements on the delivery star wheel and the centering heads on the turntable or synchronization between the receiving positions of the delivery star wheel and the pressing elements is only guaranteed during operation when there is no jamming up at the outlet of the delivery star wheel. To prevent major damage to the pressing station when there is a jamming up at the outlet of the delivery star wheel, the delivery star wheel is coupled with the drive by means of a slip clutch. If a jamming up does occur, then the delivery star wheel can slip in relation to the drive. That construction requires pivotable pressing elements which are oriented concentrically to the receiving positions causing the synchronization between the turntable and the pressing elements is lost. When rotation continues, therefore, even with the pressing elements pivoted back, collisions may occur. In the other pressing station of the prior art described above, with the support for the pressing elements offset and not torsionally connected to the delivery star wheel, a slipping of the delivery star wheel in relation to the drive as a result of a jam leads to an offset between the receiving positions and the pressing elements corresponding to the receiving positions in the pressing area. Once again, the result is that the pressing elements can no longer be placed centrally over the bottle tops.

OBJECT THE INVENTION

One object of the present invention, therefore, is to create a labelling machine that eliminates or reduces the problems associated with such machines and allows for the positioning of a label brush inside the path of the bottles in the machine.

SUMMARY OF THE INVENTION

The above-mentioned object is achieved by the present invention that provides, on the bottle support inside the receptacles, a central guide body with an axial bearing for the adjustable columns and a pivot, or rotational, bearing located on the outside circumference of the bottle support, that has a stationary support ring for the brush elements mounted thereon.

The labelling machine according to the present invention is simply constructed, because there is no independent guide element mounted on the bottle support for each column. Rather, a common guide body is provided that guides the columns as well as the support ring for the brush elements. Since the support ring also extends in the vicinity of the area between the feeder star wheel and the discharge star wheel, a holder in this area can be positioned away from, or moved out of the way of the bottle support so that no collision with moving parts of the bottle support occurs. The holder holds the support ring so that it does not rotate together with the rotating bottle support and the guide body on which the support ring is mounted.

In one embodiment of the invention, to keep the centering heads in the correct pivot position with as little force as possible exerted on the cam transmissions and to execute the adjustment movement, the engagement elements of the cam transmissions of all the actuators are connected by a transmission element with a radial cantilever arm connected to the column. Because of the lever translation of the radial cantilever arm, the pivot position of the cantilever arm supporting the centering head can be precisely executed with relatively low force. Moreover, the control cam has a larger diameter than the orbit of the columns. The required adjustment movements are therefore distributed over a larger cam, and thus produce a comparatively small surface load.

In another embodiment of the present invention, the centering heads are moved by a force that is independent of the power, capacity, output, or rate at which the equipment is being operated. This independent force is due to the fact that the cam of the cam transmissions of all the actuators is a cylinder, or groove, cam having opposed flanks on which the engagement elements, or cam followers, are guided. An axial guide is provided for each engagement element between the engagement element and the bottle support. The axial guide consists of an axial groove. Therefore, the invention allows for the elimination of the retainer spring of the prior art machines, to guarantee the required movement of the centering head at any power, capacity, output, or rate at which the equipment is being operated. A secondary task provided by the retainer spring of the prior art machines is to compensate for bottle height tolerances. Such compensation can be performed, according to the present invention, by an existing flexible pressure pad in the centering head that is employed for the application of a foil sheet around the bottle top on all sides. Also, such compensation may be provided by flexibly supporting the centering head on the cantilever arm. In this case, the spring must be designed for the retention of the centering head, however, since its mass is small compared to the total mass of the centering head, cantilever arm, column and engagement element, and the travel required to compensate for tolerances is small, there is no need for a particularly strong spring.

To be able to make an adjustment for different bottle heights, another embodiment of the present invention provides that the axial position of the cantilever arm on the column is adjustable. In that embodiment, preferably, the axial position of the cantilever arm is determined by a stop that is supported on the exposed end surface of the column. The stop of each cantilever arm is designed to be replaceable. That construction facilitates the conversion from one bottle size to another because all that is necessary for the refitting is the replacement of one set of stops with another set of stops. This type of design is particularly simple if the stop is designed as a sleeve that is closed by a base that can be inserted over the column.

For the conversion of the labelling machine when changing bottle diameters, it is necessary to replace the brush elements. This can be accomplished easily, according to the present invention, if the support ring for the brush elements is axially fastened to the guide body by means of a releasable holding element. After the release of the holding element, the support ring can then be axially retracted from the guide body. For such a format conversion, however, it is also necessary to remove the cantilever arms supporting the centering heads. That removal is necessary, anyway, if the machine is being refitted for bottles of a different diameter or a different height.

According to another embodiment of the present invention, the drive mechanisms can be easily protected against water and dirt because the substructure and the bottle support form two shells enclosing the drive mechanisms. At their outer edges, located next to one another, these shells can be sealed, preferably, by a labyrinth seal. In this embodiment, the necessary freedom of movement remains between the substructure and the bottle support.

One aspect of the invention resides broadly in a brushing station for a labelling system for labelling bottles and the like that includes a bottle conveying device for moving bottles along a portion of a generally circular path of travel and apparatus for supporting brush apparatus in intermittent contact with exterior surfaces of bottles being conveyed along the portion of the generally circular path of travel. The brush supporting apparatus is positioned within the generally circular path of travel. The brush supporting apparatus is positioned adjacent to the bottle conveying device and the exterior surfaces of bottles moving along the portion of the generally circular path of travel. A centering head device moves along the generally circular path of travel and is for being in removable engagement with tops of bottles. The centering head device is axially movable at least through a portion of its travel toward and away from tops of bottles. A guide body is provided for being generally concentrically positioned and for being rotatable within the generally circular path of travel. The guide body is for guiding the centering head device axially toward and away from tops of bottles and for positioning said brush supporting apparatus adjacent to the bottle conveying device and exterior surfaces of bottles moving along the portion of the generally circular path of travel.

Another aspect of the invention resides broadly in a brushing station for a labelling system for labelling bottles and the like that includes a bottle conveying device for moving bottles along a portion of a generally circular path of travel and apparatus for supporting brush apparatus being in intermittent contact with exterior surfaces of bottles being conveyed along the portion of the generally circular path of travel. The brush supporting apparatus is positioned within the generally circular path of travel and adjacent to the bottle conveying device and exterior surfaces of bottles moving along the portion of the generally circular path. A centering device is provided for centering bottles as bottles move along the generally circular path of travel.

Yet another aspect of the invention resides broadly in a brushing station for a labelling system for labelling bottles and the like which includes a bottle conveying device for moving bottles along a portion of a generally circular path of travel. A centering head device is provided for moving along the generally circular path of travel and for being in removable engagement with tops of bottles. The centering head device is axially movable at least through a portion of its travel toward and away from tops of bottles. A guide body is provided for being generally concentrically positioned and for being rotatable within the generally circular path of travel. The guide body is for guiding the centering head device axially toward and away from tops of bottles.

In summing up, the invention includes a pressing station for foil sheets applied around the top and neck of bottles in a labelling machine. The labelling machine has a foil sheet transfer station located along a turntable for the bottles which transfers the foil sheets to the bottles. It also includes a delivery star wheel in which, corresponding to each receiving spot for the bottles located on its circumference, there is a bell-shaped pressing element which can be moved by a cam controlled drive mechanism axially toward the bottle top, and wherein the pressing element is held by a support located above the delivery star wheel which rotates with the delivery star wheel. The pressing station comprises a pressing element supported on the free end of a rocker which can be adjusted in an axial plane. The other end is moved axially during the rotation of the pressing element around the axis of the delivery star wheel by a three-dimensional cam drive mechanism, and the free end is moved radially by a cam drive mechanism coupled with the rocker, as a function of the axial movement of the rocker. The cams of the two cam drive mechanisms are designed so that the pressing element is in its raised inside position in the vicinity of the turntable and is in its lower outside position in a portion of the region between the turntable and the delivery of the delivery star wheel.

Another embodiment of the invention includes an apparatus which is for pressing attached foil sheets around the top and neck of bottles. The apparatus includes an arrangement for transporting the bottles and foil sheets along a predetermined path of travel to a transfer station. Also included is an arrangement for transporting the bottles and foil sheets along a predetermined path of travel from the transfer station to a pressing station. An arrangement in the pressing station is included for pressing the foil sheets around the top and neck of the bottles. The arrangement for pressing the foil sheets comprises an operative arrangement for moving the foil pressing arrangement transversely, with respect to the path of travel of the bottles to the pressing station, from a retracted position out of the predetermined paths of travel to an extended position above the top of the bottles.

Yet another embodiment of the invention includes a method for pressing attached foil sheets around the top and neck of bottles. The method comprises the steps of transporting the bottles and foil sheets along a predetermined path of travel to a transfer station. Next, the bottles and foil sheets are transported along a predetermined path of travel from the transfer station to a pressing station. Finally, the foil pressing arrangement is moved transversely with respect to the path of travel of the bottles to the pressing station, from a retracted position out of the predetermined paths of travel to an extended position above the top of the bottles.

The invention is explained in greater detail below with reference to one embodiment illustrated in the accompanying figures.

BRIEF DESCRIPTION OF THE DRAWINGS

FIGS. 10 and 11 show a partial front elevational view of bottles with labels attached by the apparatus of the present invention; and FIG. 12 shows a partial front elevational view of a bottle which is engaged by the apparatus of the present invention.

DESCRIPTION OF THE PREFERRED EMBODIMENT

Figure 1:
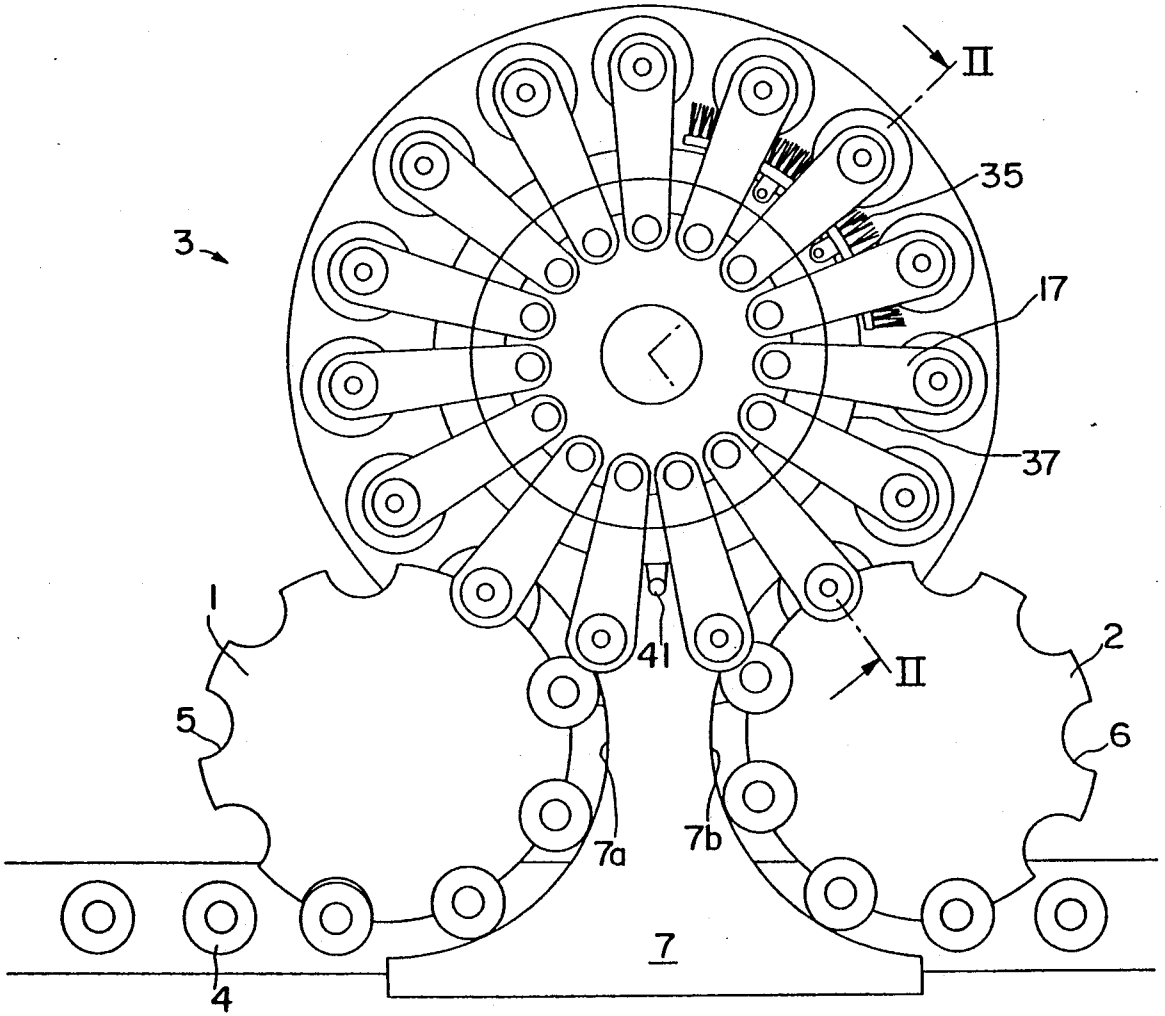
FIG. 1 is a schematic diagram of a labelling machine employing the present invention.
Figure 2:
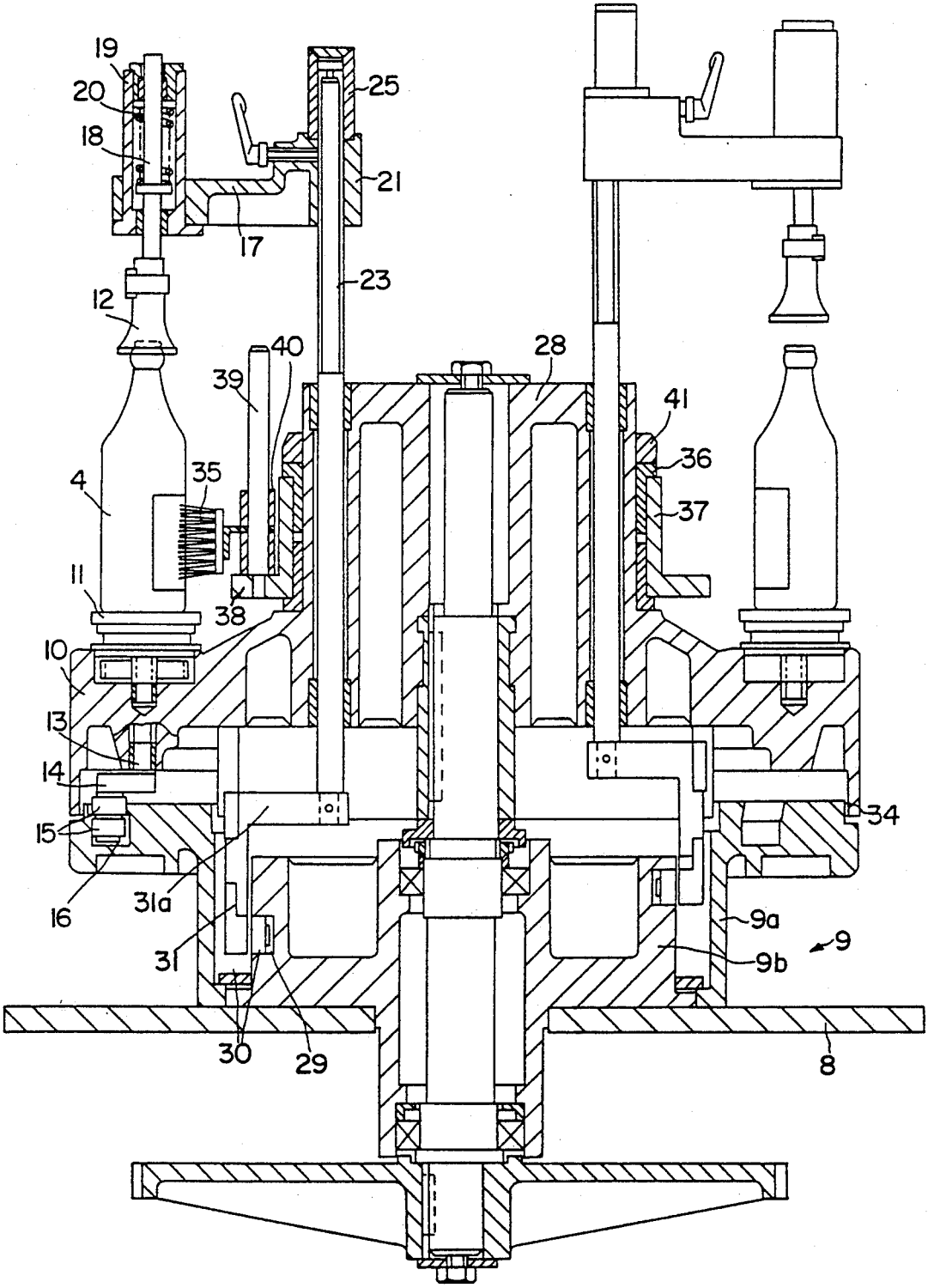
FIG. 2 is a side elevational view, partially in section, of the labelling machine illustrated in FIG. 1, taken along Line II—II in FIG. 1.
Figure 3:
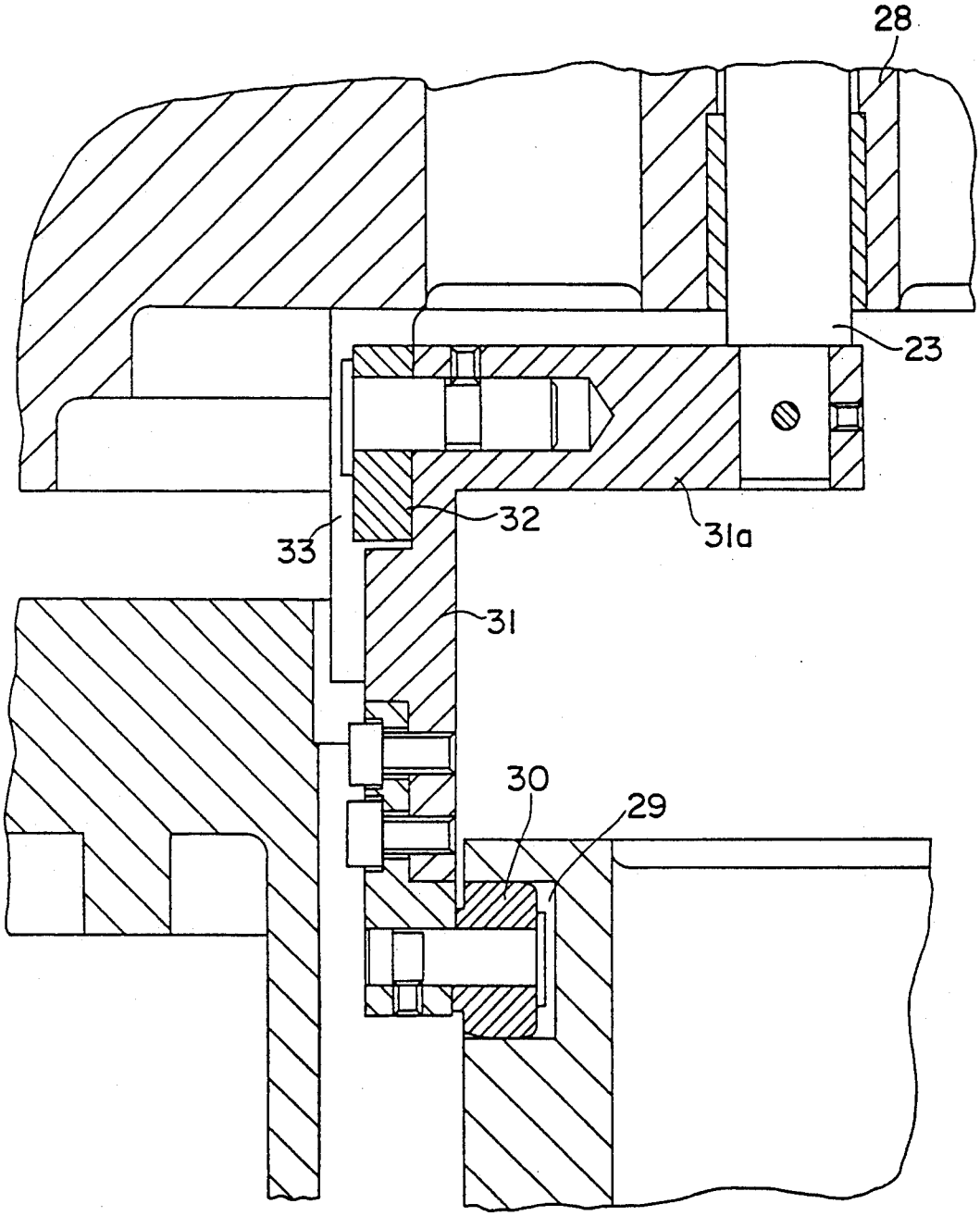
FIG. 3 is a side elevational view, partially in section, of a cam transmission actuator for the labelling machine illustrated in FIGS. 1 and 2.
Figure 4:
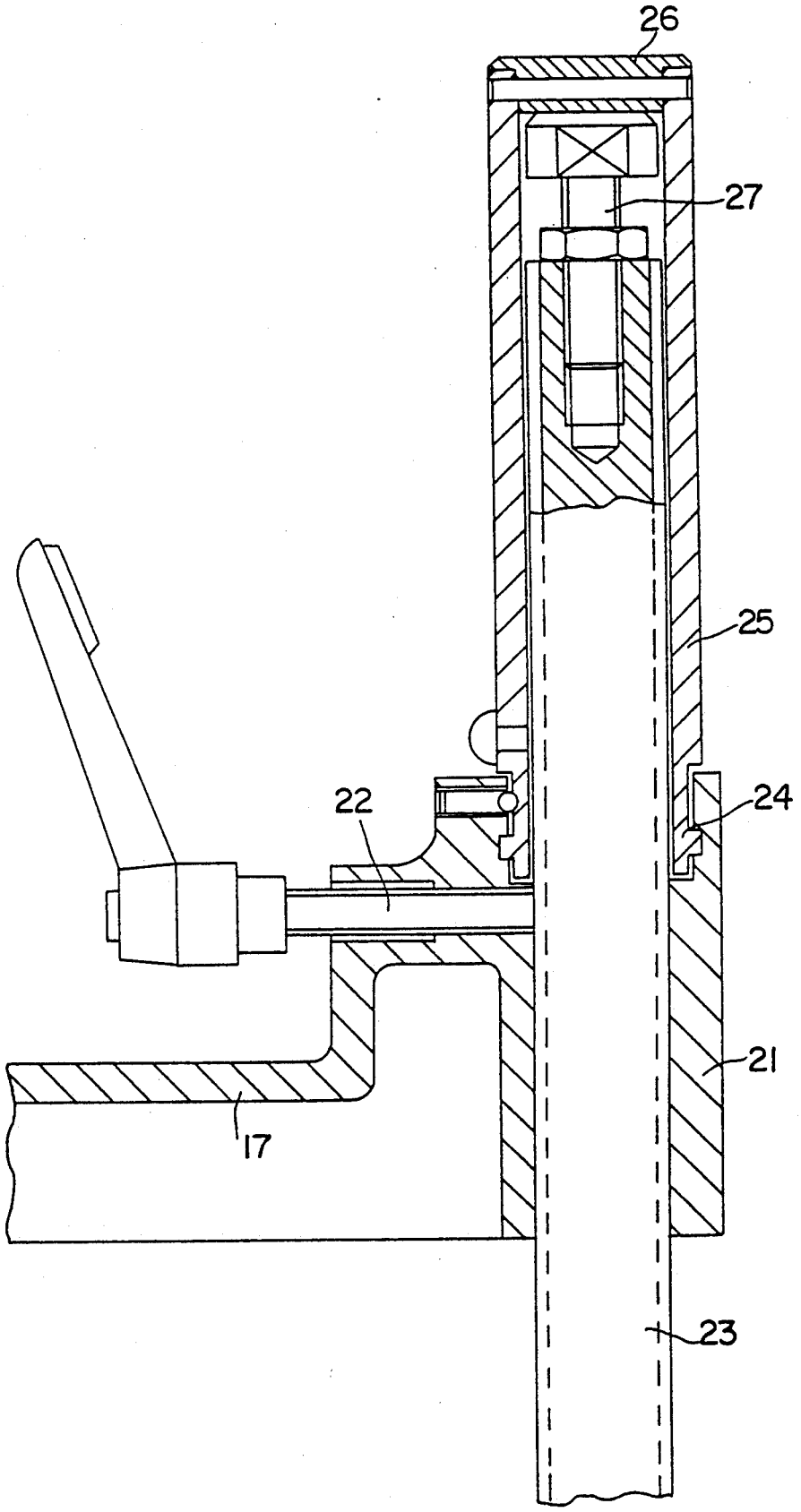
FIG. 4 is a side elevational view, partially in section of a column with a cantilever arm for a centering head for the labelling machine illustrated in FIGS. 1 and 2.

The labelling machine illustrated in FIGS. 1–4 has a feeder star wheel 1, a discharge star wheel 2 and a turntable 3 located therebetween. The feeder star wheel 1 and the discharge star wheel 2 have on their circumference, pockets 5 and 6 to hold the bottles 4 on which the labels are to be applied. Corresponding cam guides 7*a* and 7*b* of a guide element 7 are located between the feeder star wheel 1 and the discharge star wheel 2 so that the bottles 4 are held in the pockets 5 and 6.

The turntable 3 includes a two-piece substructure 9, having substructure parts 9*a* and 9*b*, positioned on a table board 8 and a bottle support 10 mounted so that it can rotate on the substructure parts 9*a* and 9*b*. The substructure parts 9*a* and 9*b* of the substructure 9 can be adjusted independently of one another with respect to their rotary positions on the table board 8. Rotary plates 11 are mounted on the bottle support 10. Centering heads 12, corresponding to the rotary plates 11, and whose distance from the rotary plates 11 can be modified by means of actuator drive mechanisms described in greater detail below, are also provided. The rotary plates 11 and the centering heads 12 form receptacles for the bottles to be labelled and brace the bottles axially while the labels are transferred to them by a labelling station (not shown) on the outer circumference of the turntable 3. Also provided are cam-controlled drives corresponding to both the rotary plates 11 and the centering heads 12.

Thus each rotary table 11 is connected by a drive shaft 13, generally with an interposed translation transmission, to a lever arm 14. The lever arm 14 supports two cam rollers 15, that are engaged as the engagement element in a plane, stationary groove cam 16 of the outer substructure part 9*a* of the substructure 9. The path of the groove cam 16 is such that when the bottle support 10 rotates, the bottle 4 to be labelled is rotated past the station located on the path so that a label is transferred and applied to the circumference of the bottle 4.

The centering head 12 is supported by a radial cantilever arm 17 through guide pin 18 in a guide bushing 19 so that the centering head 12 can move axially against the force of a biasing spring 20. The spring 20 is compressed to exert axial elastic force and to compensate for tolerances.

The cantilever arm 17, on the end away from the centering head 12, has a guide bushing 21 that can be clamped in a stationary manner to a column 23 by a pulling bolt 22. In the guide sleeve 21, a stop 25, in the form of a sleeve closed at one end by a base 26, is locked by a bayonet-type connection. The base 26 is in contact with a set screw 27 located on one end of the column 23. The set screw 27 is used for precision adjustment, while the length of the sleeve-shaped stop 25 basically determines the axial position of the bushing 21 on the sleeve 23. By selecting sleeve-shaped stops of different lengths, it is possible to configure the machine for bottles of various heights.

The columns 23 of all the centering heads 12 are mounted in a common central guide body 28 that is part of the bottle support 10. The columns 23 can move axially in the guide body 28. The axial position of columns 23 is determined by a stationary groove cam 29, that is a cylinder cam located in the substructure 9. An engagement element or cam follower 30 is guided in the groove cam 29 on both flanks, or sides, of the groove cam 29. In the embodiment of the invention shown in FIGS. 1–4, a simple cam roller is shown. For higher capacities and/or to exert the lowest possible load, the engagement element 30 can be designed as a double cam roller, like the cam roller 15. The engagement element 30 is supported by an angular transmission element 31, whose radial cantilever arm 31*a* is rigidly connected to the column 23. Elements 31 and 31*a* support an additional engagement element 32 that is a sliding block that is engaged in an axial groove 33 formed in the bottle support 10. The engagement element 32 and the axial groove 33 form an axial guide for the transmission element 31 and prevent a twisting of the columns 23. On account of the radial cantilever arm 31*a*, the diameter of the groove cam 29 is larger than the diameter of the concentric circle which is defined by the columns 23. That construction produces a low cam load. An additional advantage of the radial cantilever arm is that because of the lever translation, only small forces are necessary to hold the centering element 12 in the correct pivot position.

The bottle support 10, on which the moving parts of the drive mechanisms for the rotary plates 11 and the centering heads 12 are mounted, and the substructure 9 that holds the stationary cams 16 and 29 together, form facing shells, having edges that form a labyrinth seal 34. As a result of the labyrinth seal 34, the penetration of dirt and water into the inside of the shells is largely prevented.

The central guide body 28 is employed not only for the axial guidance of the columns 23, but also as a bearing or mounting for the brush elements 35. For that purpose, central guide body 28 has on its outside circumference a pivot, or rotational bearing 36, has a bearing bush with a two-piece collar, on which a support ring 37 is mounted so that the body 28 can rotate relative to the ring 37. By means of a releasable ring-shaped holding element 41 that is positioned between feeder star wheel 1 and discharge star wheel 2, the pivot bearing 36 and, thus also, the support ring 37, that is held between the collars, is fastened to the guide body 28. The support ring 37 has a base 38 with axial insertion pins 39 installed on it. The brush elements 35 are mounted on pins 39 by a support element 40. The support ring 37 is fastened to the guide element 7 by means of the holder 41 out of the vicinity of the rotary plates 11 and centering heads 12 between the feeder star wheel 1 and the discharge star wheel 2, so that when the bottle support 10 rotates, the support ring 37 does not rotate along with it.

To perform the conversion to another bottle size, or format, the radial cantilever arms 17 with the centering heads 12 are removed from the columns 23 and the stops 25 are replaced by stops appropriate to the new height, size or format of the bottles. When the cantilever arms 17 are removed, the support ring 37 can also be axially extracted from the guide body 28, after the removal of the ring-shaped holding element 42 and replaced by another support ring which is equipped with other brush elements. For a format adjustment to different diameters of the bottles, however, such a disassembly is generally unnecessary, because the brush elements 35 with their support element 40 can be exchanged while the support ring 37 is still in place.

Figure 5:
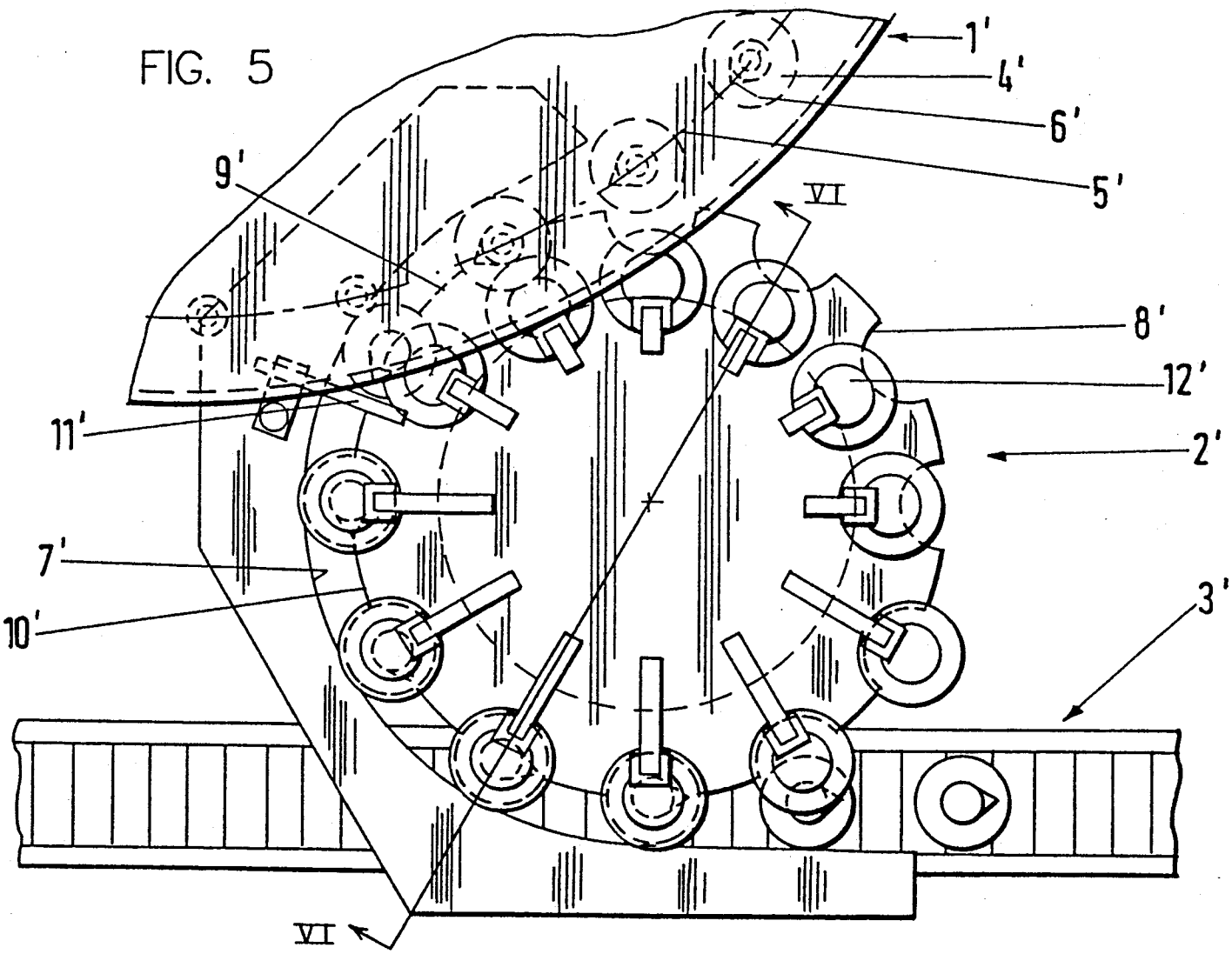
FIG. 5 shows a pressing station as part of a labelling machine, schematically and in a plan view.

FIG. 5 is a schematic illustration of a labelling machine, showing only a turntable 1', a delivery star wheel 2' and a plate or platform conveyor belt 3'. On bottles 4' which are transported by the turntable 1' on a circular transport path 5', foil sheets 6' are applied by a transfer station located in a fixed position on the transport path 5', but not shown, and are then pressed against the neck of the bottle by brushes, also not shown. Since the bottles 4' during this transport are held in place by centering heads which engage the top of the bottle, the foil sheets 6' cannot lie flat on the end surface of the bottle top while the bottles 4' are held by the centering head. By means of a guide element 7' projecting into the transport path 5', the bottles, after being released from the axial bracing, are transferred from their receiving positions in the turntable 1' to receiving positions 8' on the outside circumferences of the delivery star wheel 2', and are held by the guide element 7' over the remaining transport distance into the receiving positions 8' until they are delivered onto a plate or platform conveyor belt 3'. So that the bottles 4' do not slip inside the receiving positions 8', these receiving positions 8' are lined with non-slip elements.

In segment 9' of the transport path of the bottles 4', which forms the transition between the transport path 5' in the turntable 1' and the transport path 10' in the delivery star wheel, there is a fixed folding element 11', which as each bottle passes, folds back the peak of the foil sheet 6' projecting beyond the top of the bottle. For each receiving position 8', there is a pressing element 12' as shown schematically in FIG. 5, which is located in different radial positions as a function of its position on the circulation path 10'. In the vicinity of the turntable 1' it is in its inside position, so that a collision-free passage is possible on the turntable 1', in particular past its centering elements, while in the segment between the turntable 1' and the delivery, it is in its radially outside position. As FIG. 5 shows, the activation begins very early, namely as far back as in the vicinity of the folding mechanism 11'.

Figure 6:
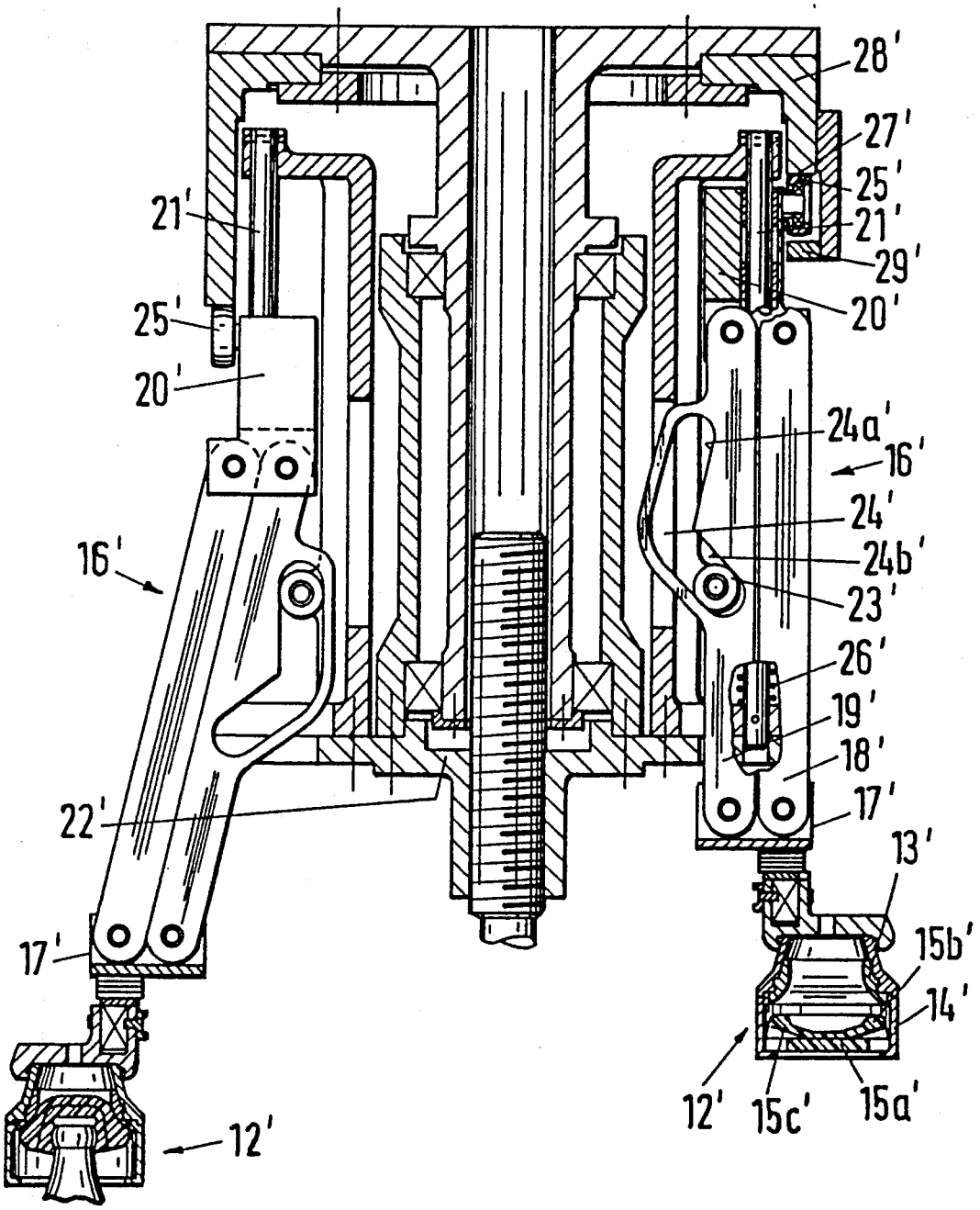
FIG. 6 shows a support with pressing elements in an axial section along line VI—VI in FIG. 5.

In FIG. 6, on the left, the pressing element 12' is shown in the lower, radially outside position, and on the right, in the upper, radially inside position. The pressing element 12' consists of a bell-shaped housing 13' and a two-layer plate 15*a'*, 15*b'* held in front of the opening of the housing 13' by means of a support ring 14'. The plate 15*a'*, 15*b'* has a ring-shaped bulge 15*c'* on its back side, and is supported with its ring-shaped bulge 15*c'* against the bell-shaped inside wall of the housing 13'. The plate 15*a'*, 15*b'* has ribs running radially to the peripheral edge, in the undeformed state enclosing spaces between them, which in the deformed state are in non-overlapping contact in the top and neck area of the bottle 4'. Such a pressing element or a similar one is the object of German Laid Open patent application P 37 20 529.3 and German patent application P 37 28 958.6.

The pressing element 12' is supported by a duplex crank 16' designed as a parallel crank, and in particular by its coupling element 17'. The two rockers 18', 19' of the duplex crank 16' are supported by its fixed link 20', which is mounted on two parallel guide rods or rails 21' (shown) so that it will not rotate or pivot, but so that it can be displaced axially. The rails 21' are held in a support 22', which is mounted on the delivery star wheel 2' and is driven jointly with the latter. An engagement element 23' of a cam drive mechanism is also mounted in the support 22' so that it can rotate, and includes a slot cam 24' on the rocker 19'. The slot cam 24' comprises two segments 24*a'*, 24*b'*. Segment 24*a'* is used for the axial movement, and segment 24*b'* for a combined axial and radial movement of the pressing element 12'.

The fixed link 20' supports, as the engagement element of a three-dimensional cam drive mechanism, a roller 25', which is pressed by means of a spring 26' acting on the fixed link 20' against a corresponding cylinder cam 27', which is supported by a frame 28' which does not rotate. There is a support element 29' opposite the cylinder cam 27', primarily in the region of the turntable 1', to prevent the pressing element 12' from moving under its own weight, if the spring 26' breaks, from the inside radial position shown on the right in FIG. 6 to the outside radial position shown on the left.

During operation, the pressing elements 12' reach the top inside radial position in the region adjoining the turntable 1'. In this position they lie outside the area traversed by the centering heads, which are still active here. As soon as the centering heads are raised and the bottles 4' are released by the guide element 7' for their transfer to the delivery star wheel 2', the three-dimensional cam drive mechanism 25', 27' lowers the duplex crank 26' with the pressing element 12'. During this descending movement, on account of the curvature of the segment 24*b'* of the slot cam 24', there is a radial movement of the pressing element 12' outward, until the end of this segment is reached. As the descent continues, then, the rest of the movement is an axially parallel descent, because in this movement segment, the segment 24*a'* of the slot cam runs parallel to the descent produced by the rails 21'. During this second segment of the movement, the rockers 18', 19' are already in contact with one another and brace one another. Therefore they absorb the reaction force which occurs during pressing, without transmitting this force to the cam drive mechanism 23', 24' Shortly before the delivery on the platform or plate conveyor belt 3', the duplex crank 16' is again raised, so that the bottles 4' with foil pressed on all sides can be transferred to the platform or plate conveyor belt 3'.

Figure 7:
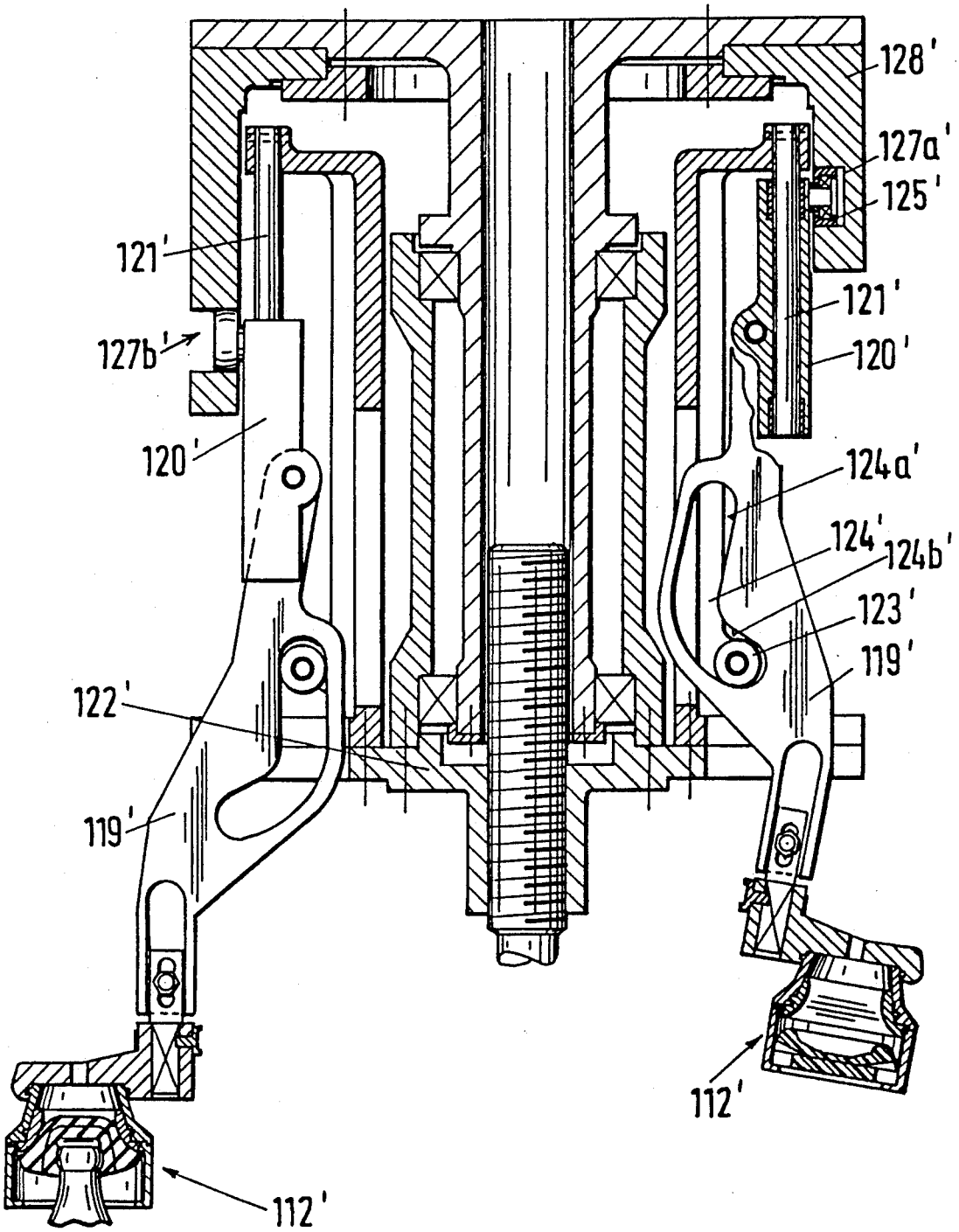
FIG. 7 shows a support with pressing elements in an axial section along line VI—VI in FIG. 5, in a model which is different from the one illustrated in FIG. 6.
Figure 8:
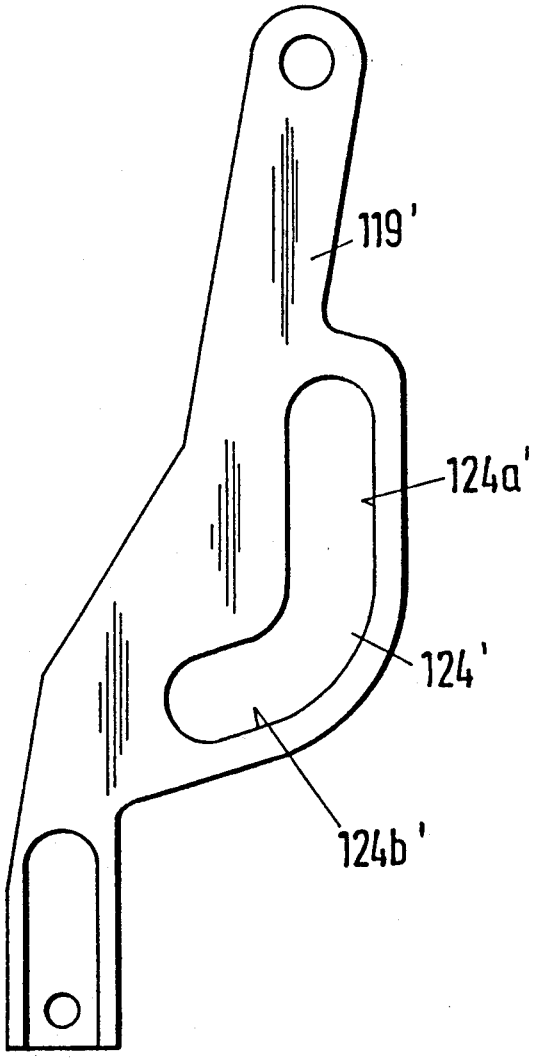
FIG. 8 shows the rocker of the three-dimensional cam drive mechanism illustrated in FIG. 7, in a side view.
Figure 9:
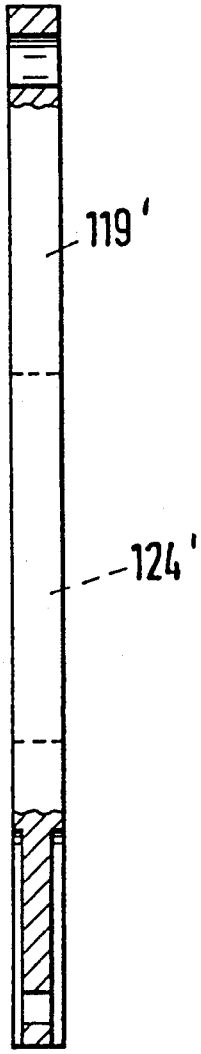
FIG. 9 shows a front view of the rocker illustrated in FIG. 8, with portions broken away to show certain details.

The embodiment illustrated in FIGS. 7 to 9 is the same as the embodiment illustrated in FIG. 5, except for the supports of the cams and the rockers. Identical parts have therefore been identified by the same number, plus 100. The support of the three-dimensional cam drive mechanism 128' is designed as a cylindrical drum. Its cam comprises a flat curve segment 127*a'* lying in a radial plane, and a three-dimensional cam segment 127*b'* which extends over several radial planes. The plane cam segment 127*a'* is designed as an closed slot cam, while the three-dimensional cam segment 127*b'* is designed as an open slot cam. In this cam 127*a'*, 127*b'*, a roller 125' is guided as the engagement element of a fixed link 120' of a rocker 119'. The fixed link 120' is mounted on two parallel rails or guide rods 121' (shown) so that it cannot rotate or pivot, but so that it can move axially. On the free end of the rocker 119' designed as a one-armed lever, a pressing element 112' is rigidly mounted, so that the pressing element 112' is oriented diagonally in the raised position, and in the lowered position, its axis is parallel to the axis of the bottle.

As in the embodiment illustrated in FIG. 6, the cam 124' of the rocker 119' consists of two cam segments 124a', 124b', where the cam segment 124b' causes the radial movement and the cam segment 124a' the axially parallel guidance during lowering. The cam segment 124b' on the one hand and the three-dimensional cam segment 127b' of the three-dimensional cam drive mechanism on the other hand are matched to one another, so that during the transition from the flat cam segment 127a' into the three-dimensional cam segment 127b', when the descending movement is still small in relation to the rotational movement, the degree of radial deflection caused by the cam segment 124b' is large and becomes smaller with increasing axial movement. In this manner, the load on the cams is made more uniform. This arrangement of the curves of the cams is not limited to the embodiment illustrated in FIG. 7, but can also be used in the embodiment illustrated in FIG. 6.

Shown in FIG. 12 is a typical centering head 134' having a slightly trunconical outer periphery and which, at the bottom, has a diameter that is the same as the diameter of the bottle top 136', while at its upper part it has a slightly larger diameter. Also shown is a foil patch or sheet 135' which may be pressed in the apparatus of this invention to have a finished appearance, such as shown in FIGS. 10 and 11.

In summary, one feature of the invention resides broadly in a labelling machine for bottles with a turntable 3 located between a feeder star wheel 1 and a discharge star wheel 2, which turntable 3 has a rotating, un-hooded bottle support 10 located on a substructure 9 with receptacles for the bottles 4 on its circumference, corresponding to which, on one segment of its orbit, there are brush elements 35 located on the side, and which each consist of a motorized rotary plate 11 and a centering head 12 supported by a radial cantilever arm 17 of a column 23 which is mounted on the bottle support 10 and can be adjusted by an actuator 29, 30, whereby both the rotation drive mechanisms 14–16 of the rotary plate 11 and the actuators 29, 30 of the columns 23 are cam drives each with a common, stationary cam 16, 29 located in the substructure 9 for the cam drives 14, 16 of the rotation drive mechanisms on one hand, and the cam drives 29, 30) of the actuators on the other hand, characterized by the fact that on the bottle support 10 inside the receptacles, there is a central guide body 28 with an axial bearing for the adjustable columns 23 and with a pivot bearing 36 located on its outside circumference, on which pivot bearing 36 is mounted a stationary support ring 37 for the brush elements 35.

Another feature of the invention resides broadly in a labelling machine characterized by the fact that the engagement elements 30 of the cam transmissions 29, 30 of all the actuators are connected by means of a transmission element 31 with a radial cantilever arm 31a with the columns 23.

Yet another feature of the invention resides broadly in a labelling machine characterized by the fact that the cam 29 of the cam transmission 29, 30 of all the actuator drive mechanisms is a cylinder cam designed as a groove cam, on both flanks of which the engagement elements 30 are guided, and that for each engagement element there is an axial guide 32, 33 between the engagement element 30 and the bottle support 10.

A further feature of the invention resides broadly in a labelling machine characterized by the fact that the axial guide 32, 33 consists of an axial groove 33 and an engagement element 32.

A yet further feature of the invention resides broadly in a labelling machine characterized by the fact that each centering head 12 is flexibly mounted in the cantilever arm 17.

Yet another feature of the invention resides broadly in a labelling machine characterized by the fact that the axial position of each cantilever arm 17 on the column 23 is adjustable.

An additional feature of the invention resides broadly in a labelling machine characterized by the fact that the axial position of the cantilever arm 17 is determined by a stop 25 braced on the free end of the column 23.

A yet additional feature of the invention resides broadly in a labelling machine characterized by the fact that the stop 25 of each cantilever arm 17 is replaceable.

A further feature of the invention resides broadly in a labelling machine characterized by the fact that the stop 25 is designed as a sleeve closed on one end by a base, which can be inserted on the column 23.

A yet further feature of the invention resides broadly in a labelling machine characterized by the fact that the support ring 37 can be axially fastened to the guide body 28 by means of a removable holder element 42.

Another yet further feature of the invention resides broadly in a labelling machine characterized by the fact that the substructure 9 and the bottle support 10 form two shells holding the cam transmissions 14–16, 29, 30, whereby the shells are sealed on their outer edges next to one another, in particular by a labyrinth seal 34.

Another aspect of the invention resides in a pressing station for metal foil sheets 6' applied around the top and neck of bottles 4' in a labelling machine with a transfer station located on the turntable 1' for the bottles 4' which transfers the metal foil sheets 6' to the bottles 4'. Also included is a delivery star wheel 2', in which corresponding to each receiving spot 8' for the bottles 4' located on its circumference, there is a bell-shaped pressing element 12', 112', alternatively known as means for pressing, which can be moved by a cam controlled drive mechanism axially toward the bottle top. The pressing element 12', 112' is held by a support 22', 122' located above the delivery star wheel 2' which rotates with the delivery star wheel 2'. The pressing element 12', 112' is supported on the free end of a rocker 19', 119' which can be adjusted in an axial plane and includes operative means for moving the pressing element. The other end is moved axially during the rotation of the pressing element 12', 112' around the axis of the delivery star wheel 2' by a three-dimensional cam drive mechanism 25', 27', 125', 127a', 127b', and the free end is moved radially by a cam drive mechanism 23', 24', 123', 124' coupled with the rocker 19', 119', as a function of the axial movement of the rocker 19', 119,. The cams 24', 27', 124', 127' of the two cam drive mechanisms 23', 24', 25', 27', 123', 124', 125', 127' are designed so that the pressing element 12', 112' is in its raised inside position in the vicinity of the turntable 1' and is in its lower outside position in a portion of the region between the turntable 1' and the delivery of the delivery star wheel 2'. The cam 24', 124' of the cam drive mechanism 23', 24', 123', 124' is coupled with the rocker 19', 119' which comprises several segments 24a', 24b', 124a', 124b'. Its first segment 24b', 124b' is active during the downward movement and has at least one radial control component and the segment 24a', 124b' which is active during the pressing of the foil sheet has only one axial component. The cams 124', 127' of the two cam drive mechanisms 23', 24', 25', 27', 123', 124', 125', 127' are designed so that an initially slow descending movement of the rocker 19', 119' corresponds to a large radial movement. The cam 27', 127' of the three-dimensional cam drive mechanism 25', 27', 125', 127' lies on a drum jacket surface, in particular one which is cylindrical. The cam located on the drum jacket surface of the three-dimensional cam drive mechanism 25', 27', 125', 127' is designed as a support cam for the engagement element 25', 125' of the three-dimensional cam drive mechanism 25', 27', 125', 127', which absorbs the axial reaction force of the pressing element 12', 112' on the bottle top. The rocker 19' is part of a duplex crank 16', whose coupling element 17' supports the pressing element 12' and whose fixed link 20' is axially moved by the three-dimensional cam drive mechanism 25', 27' The duplex crank 16' is a parallel crank. The rockers 18', 19' of the duplex crank 16' are braced against one another in their outside radial position. The rocker 119' is designed as a one-armed lever, to which the pressing element 112' is rigidly fastened. The rocker 19' is prestressed by a spring 26', which presses the contact element 25' of the three-dimensional cam drive mechanism 25', 27' against the support cam 27'. The cam 127' of the three-dimensional cam drive mechanism 125', 127' has a plane cam segment **127*a'* which lies a radial plane, and a three-dimensional cam segment 127*b'* which extends over several radial planes, and is designed on the inside as a drum-shaped support, whereby the plane curve segment 127*a'* is designed as a closed slot cam, and the three-dimensional cam segment 127*b'*** is designed as a radially open slot cam.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A brushing station for a bottle labelling system for labelling bottles and the like, said brushing station comprising:

bottle conveying means for moving bottles along a portion of a generally circular path of travel;

a guide body for being generally positioned within and for being rotatable within said generally circular path of travel;

said guide body having an exterior surface with a pivot bearing disposed thereabout;

said guide body having a plurality of axial bearings being disposed within said guide body;

means for supporting brush means, which brush means is for being in intermittent contact with exterior surfaces of bottles being conveyed along the portion of said generally circular path of travel;

said brush means supporting means comprising a ring for being disposed on said pivot bearing;

said guide body being configured for rotation within said brush means supporting means;

said brush means supporting means being positioned within said generally circular path of travel;

said brush means supporting means for being positioned adjacent to said bottle conveying means and the exterior surfaces of bottles moving along the portion of said generally circular path;

means for retaining said brush means supporting means in a fixed, non-rotating position about said guide body;

a plurality of guide column means for being disposed within said plurality of axial bearings in said guide body, each of said plurality of guide column means having a first end for extending above said guide body, and a second end for extending below said guide body;

a plurality of centering head means for being disposed on said first end of said plurality of guide columns, each of said plurality of centering head means being removably engagable with tops of bottles;

each of said plurality of centering head means being movable along said generally circular path of travel;

said centering head means being axially movable at least through a portion of its travel toward and away from tops of bottles;

said guide body for axially guiding said plurality of guide columns;

a substructure for rotatably supporting at least one of: said bottle conveying means and said guide body, said substructure comprising a first cam means;

first cam follower means disposed on said second end of each of said plurality of guide columns, said first cam follower means being for following said first cam means to axially move said guide columns to move said centering head means toward and away from tops of bottles; and said guide body for positioning said brush means supporting means adjacent to said bottle conveying means and exterior surfaces of bottles moving along the portion of said generally circular path of travel.

2. The brushing station according to claim 1, wherein:

said first cam means comprises a cylinder cam having at least two opposite surfaces, said first cam follower means for riding on said at least two opposite surfaces;

said bottle conveying means comprises a turntable;

said turntable comprises a plurality of cam driven rotary plates;

each of said plurality of cam driven rotary plates having a second cam follower;

said substructure comprising second cam means; and said second cam means being for guiding said second cam follower to rotate said cam driven rotary plates relative to said turntable.

3. The brushing station according to claim 2, further including:

first arm means for connecting said guide column means to said first cam follower means;

second arm means for connecting said centering head means to said guide column means, said second arm means being removably engagable with said guide column means; and biasing means for resiliently connecting said second arm means to said centering head means.

4. The brushing station according to claim 3, further including:

adjuster means for adjusting the separation distance between said centering head means and said bottle conveying means;

stop means for limiting the separation distance between said centering head means and said bottle conveying means when said centering head means is moved away from tops of bottles;

said stop means including a sleeve having a base;

said guide column means for being inserted into said sleeve; and said base for being contacted by and limiting the movement of said guide column means.

5. A brushing station for a labelling system for labelling bottles and the like, said brushing station comprising:

bottle conveying means for moving bottles along a portion of a generally circular path of travel;

a guide body for being generally positioned within and for being rotatable within said generally circular path of travel, said guide body having an exterior surface with a pivot bearing disposed thereabout;

means for supporting brush means, which brush means is for being in intermittent contact with exterior surfaces of bottles being conveyed along the portion of said generally circular path of travel;

said brush means supporting means comprising a ring for being disposed on said pivot bearing;

said guide body being configured for rotation within said brush means supporting means, said guide body for positioning said brush means supporting means adjacent to said bottle conveying means and exterior surfaces of bottles moving along said portion of said generally circular path of travel;

said brush means supporting means being positioned within said generally circular path of travel;

said brush means supporting means for being positioned adjacent to said bottle conveying means and the exterior surfaces of bottles moving along the portion of said generally circular path;

means for retaining said brush means supporting means in a fixed, non-rotating position about said guide body; and said guide body comprising centering means for centering bottles on said bottle conveying means as bottles move along said generally circular path of travel.

6. The brushing station of claim 5, wherein:

said centering means includes:

a plurality of guide column means for being disposed within said plurality of axial bearings in said guide body, each of said plurality of guide column means having a first end for extending above said guide body, and a second end for extending below said guide body; and a plurality of centering head means for being disposed on said first end of said plurality of guide columns, each of said plurality of centering head means being removably engagable with tops of bottles;

each of said plurality of centering head means being movable along said generally circular path of travel;

each of said plurality of centering head means being axially movable at least through a portion of its travel toward and away from tops of bottles;

said guide body for axially guiding said plurality of guide columns;

means for axially moving said plurality of guide columns to move said plurality of centering head means toward and away from tops of bottles, said means for axially moving comprising a first cam follower disposed on said said second end of each of said plurality of guide columns; and a substructure for rotatably supporting at least one of: said bottle conveying means and said guide body, said substructure comprising a first cam means, said first cam follower means disposed for following said first cam means to axially move said centering head means toward and away from tops of bottles.

7. The brushing station of claim 6, wherein:

said substructure comprises a cylindrical portion;

said first cam means is a cylinder cam disposed within said cylindrical portion of said substructure, said cylinder cam having at least two surfaces; and said first cam follower means rides on said at least two surfaces.

8. The brushing station of claim 7, further including:

first arm means for connecting said guide column means and said first cam follower means;

second arm means for connecting said centering head means and said guide column means, said second arm means being removably engagable with said guide column means; and biasing means for resiliently connecting said centering head means to said second arm means.

9. The brushing station of claim 8, further including:

axial guide means for restricting relative rotational movement between said centering head means and said guide body;

said axial guide means comprising an axial groove on said guide body and an engagement element on said first arm means;

said axial groove having a surface; and said engagement element for being positioned within said groove and for following along said surface.

10. The brushing station of claim 9, further including adjuster means for adjusting the separation distance between said centering head means and said bottle conveying means.

11. The brushing station of claim 10, further including:

stop means for limiting the separation distance between said centering head means and said bottle conveying means when said centering head means is moved away from tops of bottles;

said stop means including a sleeve having a base;

said guide column means for being inserted into said sleeve; and said base for being contacted by and limiting the movement of said guide column means.

12. The brushing station of claim 11, further including:

brush means for brushing exterior surfaces of bottles, said brush means for being supported by said brush means supporting means in a fixed position relative to said guide body;

said retaining means for being connected to said brush means supporting means; and said retaining means extending outside said portion of said generally circular path.

13. The brushing station of claim 12, wherein:

said bottle conveying means comprises a turntable, said turntable having a plurality of cam guided rotary plates for rotating bottles relative to said turntable; and said substructure further comprises second cam means, said second cam means being for guiding said cam guided rotary plates.

14. The brushing station of claim 13, wherein:

said bottle conveying means supported on said substructure form an interior cavity between said bottle conveying means and said substructure, said bottle conveying means supported on said substructure for enclosing said first cam means and said second cam means within said interior cavity; and said brushing station further includes seal means for sealing said interior cavity from an exterior environment of said brushing station.

15. The brushing station of claim 14, wherein:

said seal means is a labyrinth seal;

said turntable has an entrance and an exit;

said turntable for receiving bottles from a feeder star wheel at said entrance;

said turntable for discharging bottles to a discharge star wheel at said exit;

said turntable including a rotating un-hooded bottle support;

said bottle support being positioned on said substructure;

said turntable defining a perimeter;

said turntable including a plurality of bottle receptacles at said perimeter, said bottle receptacles comprising said plurality of rotary plates in conjunction with said centering head means;

said turntable being rotatable in an orbit;

said second arm means being a radial cantilever arm;

said centering head means being movable toward and away from bottles by a cam driven activator;

said cam driven activator including said first cam means;

said first cam means being configured by said substructure;

said at least one rotary plate being rotatable by said second cam means;

said axial guide means including a transmission element, a radial cantilever arm, an axial groove and an engagement element;

said second cam means being a groove cam having first and second surfaces;

said centering head means being flexibly mounted to said radial cantilever arm;

said radial cantilever arm being axially adjustable;

said stop means being braced on said guide column means; and said support ring for being connected to said guide body by a removable holder.

16. A brushing station for a labelling system for labelling bottles and the like, said brushing station comprising:

bottle conveying means for moving bottles along a portion of a generally circular path of travel;

a guide body for being generally positioned within and for being rotatable within said generally circular path of travel;

said guide body having a plurality of axial bearings disposed within said guide body;

a plurality of guide column means for being disposed within said plurality of axial bearings in said guide body, each of said plurality of guide column means having a first end for extending above said guide body, and a second end for extending below said guide body;

a plurality of centering head means removably engagable with tops of bottles, each of said plurality of centering head means for being connected to the first end of one of said plurality of guide column means by a radial arm;

each of said plurality of centering head means being movable along said generally circular path of travel;

said centering head means being axially movable at least through a portion of its travel toward and away from tops of bottles;

said guide body for axially guiding said plurality of guide columns;

a substructure for rotatably supporting at least one of: said guide body and said bottle conveying means, said substructure comprising means for axially moving said plurality of guide columns to move said plurality of centering head means toward and away from tops of bottles.

17. The brushing station of claim 16, wherein said guide body has an exterior surface with a pivot bearing disposed thereabout, and said brushing station further includes:

means for supporting brush means, which brush means is for being in intermittent contact with exterior surfaces of bottles being conveyed along the portion of said generally circular path of travel;

said brush means supporting means for being disposed on said pivot bearing;

said guide body being configured for rotation within said brush means supporting means;

said brush means supporting means being positioned within said generally circular path of travel;

said brush means supporting means for being positioned adjacent to said bottle conveying means and the exterior surfaces of bottles moving along the portion of said generally circular path; and said guide body for positioning said brush means supporting means adjacent to said bottle conveying means and exterior surfaces of bottles moving along the portion of said generally circular path of travel.

18. The brushing station according to claim 16, wherein said radial arm comprises:

a portion for being slidably disposed on the first end of said guide column means;

stop means for limiting a separation distance between said centering head means and said bottle conveying means, said stop means having a sleeve and a base;

said first end of said guide column means for being inserted into said sleeve;

said base for being contacted by and limiting the movement of said guide column means; and means for locking the radial arm onto the first end of said guide column means to retain said radial arm in a fixed position on said guide column means.

19. The brushing station according to claim 18, wherein said guide column means has a second end for being disposed below the guide column, and said brushing station further includes:

a substructure for rotatably supporting at least one of: said bottle conveying means and said guide body, said substructure comprising first cam means, said first cam means comprising a cylinder cam;

a first cam follower disposed on a second end of each of said plurality of guide column means, said first cam follower being for following said first cam means to axially move said guide column means to move said centering head means towards and away from tops of bottles.

20. The brushing station according to claim 19, wherein:

said bottle conveying means comprises a turntable, said turntable having a plurality of cam guided rotary plates for rotating bottles relative to said turntable;

said cam guided rotary plates having second cam follower means;

said substructure further comprises second cam means, said second cam means being for guiding said second cam follower means to rotate said cam guided rotary plates during rotation of said guide body;

said bottle conveying means supported on said substructure form an interior cavity between said bottle conveying means and said substructure, said bottle conveying means supported on said substructure for enclosing said first cam means and said second cam means within said interior cavity; and said brushing station further included seal means for sealing an interior cavity from an exterior environment of said brushing station.

* * * * *

UNITED STATES PATENT AND TRADEMARK OFFICE

CERTIFICATE OF CORRECTION

PATENT NO. : 5,185,053

DATED : February 9, 1993

INVENTOR(S) : Josef TOMASHAUSER and Rudolf ZODROW

It is certified that error appears in the above-indentified patent and that said Letters Patent is hereby corrected as shown below:

In column 15, line 55, Claim 6, after 'guide', delete "column means" and insert --columns--.

In column 15, line 59, Claim 6, after 'body', delete ",".

In column 16, line 14, Claim 6, after 'comprising', delete "a".

In column 16, line 15, Claim 6, after 'means', delete "disposed" and insert --being--.

In column 18, line 5, Claim 16, after 'body', delete ",".

In column 18, line 33, Claim 17, before 'portion', delete "the" and insert --said--.

In column 18, line 38, Claim 17, after the second occurrence of 'means', insert --for--.

UNITED STATES PATENT AND TRADEMARK OFFICE

CERTIFICATE OF CORRECTION

PATENT NO. : 5,185,053 Page 2 of 2

DATED : February 9, 1993

INVENTOR(S) : Josef TOMASHAUSER and Rudolf ZODROW

It is certified that error appears in the above-indentified patent and that said Letters Patent is hereby corrected as shown below:

In column 18, line 42, Claim 17, before 'exterior', delete "the".

Signed and Sealed this

Third Day of May, 1994

Bruce Lehman

*Attest:*

BRUCE LEHMAN

*Attesting Officer*

*Commissioner of Patents and Trademarks*